US009736562B2

(12) United States Patent
Hu et al.

(10) Patent No.: US 9,736,562 B2
(45) Date of Patent: Aug. 15, 2017

(54) SOUND RECEIVING SYSTEM

(71) Applicant: GUANGZHOU RUIFENG AUDIO TECHNOLOGY CORPORATION LTD., Guangzhou, Guangdong (CN)

(72) Inventors: Bingqi Hu, Guangdong (CN); Jianye Chen, Guangdong (CN); Yong Liang, Guangdong (CN)

(73) Assignee: GUANGZHOU RUIFENG AUDIO TECHNOLOGY CORPORATION LTD., Guangzhou (CN)

( * ) Notice: Subject to any disclaimer, the term of this patent is extended or adjusted under 35 U.S.C. 154(b) by 168 days.

(21) Appl. No.: 14/394,448

(22) PCT Filed: Sep. 30, 2013

(86) PCT No.: PCT/CN2013/084789
§ 371 (c)(1),
(2) Date: Oct. 14, 2014

(87) PCT Pub. No.: WO2014/071788
PCT Pub. Date: May 15, 2014

(65) Prior Publication Data

US 2015/0063591 A1 Mar. 5, 2015

(30) Foreign Application Priority Data

Nov. 8, 2012 (CN) ..... 2012 1 0445720

(51) Int. Cl.
*H04R 3/00* (2006.01)
*H04R 1/08* (2006.01)
*H04R 1/40* (2006.01)

(52) U.S. Cl.
CPC ..... *H04R 1/08* (2013.01); *H04R 3/005* (2013.01); *H04R 1/406* (2013.01); *H04R 2201/403* (2013.01)

(58) Field of Classification Search
CPC ..... H04R 1/08; H04R 1/406; H04R 3/005; H04R 29/005; H04R 2201/401;
(Continued)

(56) References Cited

U.S. PATENT DOCUMENTS 4,649,392 A * 3/1987 Apostolos ..... G01S 3/74 324/76.35
6,042,546 A * 3/2000 Bae ..... G10K 11/34 128/916
(Continued)

FOREIGN PATENT DOCUMENTS

CN 1645971 A 7/2005
CN 101447190 A 6/2009
(Continued)

OTHER PUBLICATIONS

International Search Report mailed Jan. 2, 2014 in International Application No. PCT/CN2013/084789.
(Continued)

*Primary Examiner* — William A Jerez Lora
(74) *Attorney, Agent, or Firm* — Polsinelli PC

(57) ABSTRACT

A sound receiving system is disclosed, each of the plurality of basic array devices has an output terminal connected with one filter, each of the plurality of filters has an output terminal connected with an input terminal of the second sound-mixing output device; the basic array device includes a microphone array, the microphone array includes a plurality of microphones longitudinally arranged along a straight line in order, and two adjacent microphones in the microphone array are separated with a distance of $$\frac{1}{n}\lambda;$$

each microphone has an output terminal connected with one of the time delay circuits, each time delay circuit has an
(Continued)

output terminal connected with an input terminal of the first sound-mixing output device; and the i-th time delay circuit has a delay time defined by adding (n-i) times of unit time to a delay time of the last time delay circuit. The present invention can increase the output of the forward acoustic wave actuation, decrease the output of the oblique acoustic wave within a center frequency bandwidth, and obtain a required directional characteristic. The present invention can be widely used in sound pickup (sound transmitting) applications.

8 Claims, 3 Drawing Sheets

(58) Field of Classification Search
CPC ..... H04R 2201/403; H04R 2201/405; G10L 2021/02166
USPC ..... 381/56, 58, 92, 182, 186, 335
See application file for complete search history.

(56) References Cited

U.S. PATENT DOCUMENTS 6,678,210 B2 * 1/2004 Rowe ..... G10K 11/343 367/102
9,264,813 B2 * 2/2016 Riggs ..... H04R 5/02
2003/0214880 A1 * 11/2003 Rowe ..... G10K 11/343 367/103
2004/0175006 A1 * 9/2004 Kim ..... H04R 1/406 381/92

FOREIGN PATENT DOCUMENTS

| | | | |
|---|---|---|---|
| CN | 102761805 | A | 10/2012 |
| CN | 102970639 | A | 3/2013 |
| CN | 202940957 | U | 5/2013 |
| GB | 2438259 | A | 11/2007 |
| JP | 2007006353 | A | 1/2007 |

OTHER PUBLICATIONS

Search Report & First Office Action for Priority Chinese Patent Application No. 201210445720.X, mailed on Oct. 8, 2014 (Official Copy only).
Supplementary Search Report & Second Office Action for Priority Chinese Patent Application No. 201210445720.X, mailed on Apr. 7, 2015 (Official Copy only).

* cited by examiner

SOUND RECEIVING SYSTEM

RELATED APPLICATIONS

This application is a United States National Stage Application filed under 35 U.S.C 371 of PCT Patent Application Serial No. PCT/CN2013/084789, filed Sep. 30, 2013, which claims Chinese Patent Application Serial No. CN201210445720.X, filed Nov. 8, 2012, the disclosure of all of which are hereby incorporated by reference in their entirety.

TECHNICAL FIELD

The present invention relates to the field of sound processing technology, and more particularly, to a sound receiving system with a longitudinal linear array including a plurality of microphones.

BACKGROUND

In applications of sound reinforcement equipment, a major problem that affects the gain of a sound reinforcement system is that the direct sound received by a microphone has the same frequency and same phase as the acoustic signals fed back by various reasons. It thus is easy to generate a positive feedback and cause howling in the sound reinforcement system.

The feedback acoustic wave and the acoustic wave ought to be received by the microphone are generally heading in different directions, so the most common approach to solve the above problem is to enhance the directional characteristic of the microphone to reduce the impact of the feedback acoustic wave.

The existing cardioids or super cardioids microphone is generally most sensitive to the acoustic wave input incoming the front, and is not sensitive to the acoustic wave incoming from the back, such that the feedback acoustic wave from the back can be inhibited, but sometimes the feedback acoustic wave incoming from above, below, left or right would also causes interference.

The "8" shaped direction microphone is generally sensitive to the acoustic wave incoming both from the front and back, and is not sensitive to the acoustic wave incoming from above, below, left or right. Thus, the feedback problem of the acoustic wave from back still can't be resolved.

In addition, the existing cardioids, super cardioids and "8" shaped direction microphone have different directional responses for acoustic waves with different frequencies.

There is always a stringent requirement for a single microphone to operate in a sound environment due to limitations of gain characteristic, directional characteristic, frequency response, and so on. It is often difficult to obtain a good result of sound pickup (sound transmitting) when the sound environment is relatively complex. For example, a decrease in output gain, distortion or howling could happen because of the far distance between a target sound source and a sound pickup (sound transmitting) device, a hard angle, a severe background noise or a strong feedback. Especially when the sound reinforcement equipment should be supported by a multitude of sound pickup (sound transmitting) devices, it is rather complex in regulation and adjustment. Thus, it becomes necessary to have a sound pickup (sound transmitting) device, which outputs a higher gain for a forward acoustic wave actuation, plays a greater inhibition role in oblique acoustic waves, and has a stable directivity, to simplify demands of the sound reinforcement equipment on environment, so as to meet the requirements of sound pickup (sound transmitting) in an environment with a stronger acoustic wave feedback and a higher environmental noise, achieve remote sound pickup (sound transmitting), simplify the device regulation and operation, and obtain a good result of sound reinforcement.

SUMMARY

In order to solve the above problems, the object of the present invention is to provide a sound receiving system, which has a simple structure, and has good directional reception of acoustic waves with different frequencies for output.

The proposed technical solution of the present invention is to provide a sound receiving system, including a plurality of basic array devices, a plurality of filters and a second sound-mixing output device, wherein each of the plurality of basic array devices has an output terminal connected with one filter, each of the plurality of filters has an output terminal connected with an input terminal of the second sound-mixing output device, and the second sound-mixing output device has an output terminal as an output terminal of the sound receiving system;

the basic array device includes a microphone array, a plurality of time delay circuits and a first sound-mixing output device, wherein the microphone array includes a plurality of microphones longitudinally arranged along a straight line in order, two adjacent microphones in the microphone array are separated with a distance of $$\frac{1}{n}\lambda,$$

where n is the total number of the microphones in the microphone array and λ is a wavelength derived by a center frequency given by the basic array device;

in the microphone array, each microphone has an output terminal connected with one of the time delay circuits, each time delay circuit has an output terminal connected with an input terminal of the first sound-mixing output device, and the first sound-mixing output device has an output terminal connected with an input terminal of the filter;

the i-th time delay circuit in the basic array device has a delay time defined by adding (n-i) times of unit time to a delay time of the last time delay circuit, where said unit time is a time for an acoustic signal with a frequency at a center frequency given by the basic array device to travel between two adjacent microphones after the acoustic signal axially travelling into the microphone array, n is the total number of the microphones in the microphone array, and i has a value of 1, 2, 3, . . . , or n; and the total number n of the microphones in the microphone array is an integer greater than or equal to 3.

Preferably, each of the plurality of filters is a band-pass filter, and the band-pass filter has a center frequency corresponding to the basic array device.

Preferably, the center frequencies of the plurality of basic array devices are continuously and evenly arranged with an interval of x/m octaves, where m is the total number of the basic array devices, and x octaves is a total frequency range given in the sound receiving system.

Preferably, the number of the microphones in the microphone array of each of the basic array devices is the same.

Preferably, bandwidths of the plurality of band-pass filters have a same octave, and the bandwidths of the plurality of band-pass filters cover a given total frequency bandwidth.

Preferably, the first filter at the low frequency end in the plurality of filters is a low-pass filter, the last filter at the high frequency end in the plurality of filters is a high-pass filter, the rest plurality of filters are band-pass filters with a frequency corresponding to the center frequency of the basic array device, and the bandwidths of the rest plurality of band-pass filters have a same octave.

Preferably, the total number n of the microphones in the microphone array is an even number greater than or equal to 4.

Preferably, the last microphone in the microphone array of each of the basic array devices is placed together in a same physical location and close to one another.

Preferably, the basic array device and the band-pass filter have operating frequency bandwidths that meet directivity requirements.

The present invention has the advantages that the microphone array of the basic array device of the present invention can increase the output of the forward acoustic wave actuation and decrease the output of the oblique acoustic wave within a center frequency bandwidth due to the microphone array composed by discrete, equally spaced and longitudinally aligned microphones based on a preset center frequency, and the microphone array can obtain an approximately identical directional characteristic at the central frequency and adjacent frequencies, in such a way, the basic array device of the present invention can obtain a good effect of sound reinforcement in an environment with a stronger acoustic wave feedback and a higher environmental noise. In addition, the present invention includes a plurality of basic array devices, and the plurality of basic array devices are provided with a plurality of different operating frequency ranges, such that the plurality of operating frequency ranges can make up a wider frequency bandwidth. Thus the present invention has a good directional reception of an acoustic wave in a given frequency range, and has a simple structure, convenient implementation and low cost.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DETAILED DESCRIPTION OF THE PREFERRED EMBODIMENTS

Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

Figure 1:
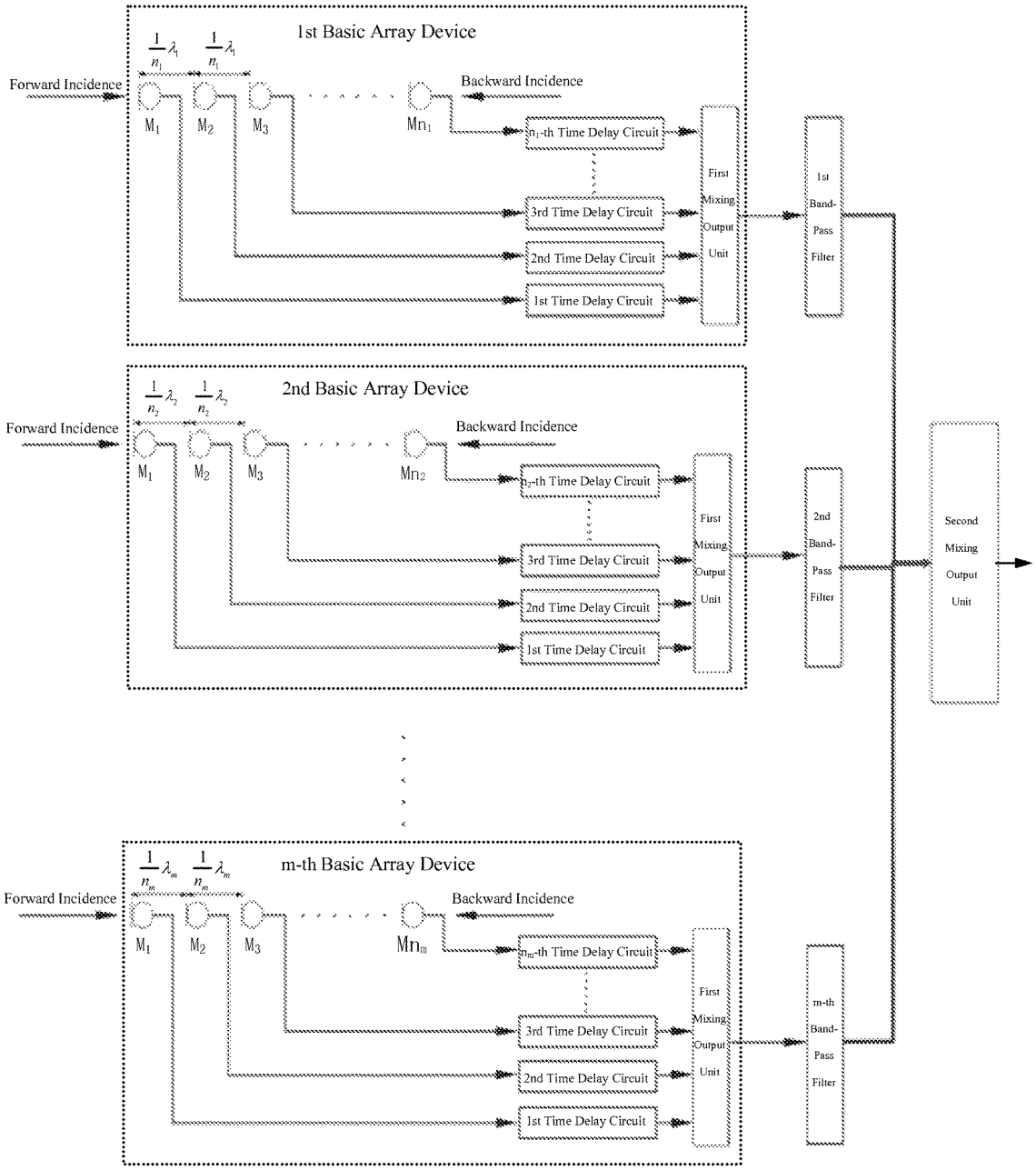
FIG. 1 is a structure diagram illustrating a sound receiving system according to one embodiment of the present invention.

As shown in FIG. 1, a sound receiving system includes a plurality of basic array devices, a plurality of filters and a second sound-mixing output device, wherein each of the plurality of basic array devices has an output terminal connected with one filter, each of the plurality of filters has an output terminal connected with an input terminal of the second sound-mixing output device, and the second sound-mixing output device has an output terminal as an output terminal of the sound receiving system. The plurality of filters can be band-pass filters.

The basic array device includes a microphone array, a plurality of time delay circuits and a first mixing output unit, the microphone array includes a plurality of microphones which are M1, M2, M3, . . . , and Mn, and each of the microphones has basically the same frequency response, sensitivity, directional characteristic and other properties.

The plurality of microphones M1, M2, M3, . . . , and Mn are longitudinally arranged along a straight line in order, and two adjacent microphones in the microphone array are separated with a distance of $$\frac{1}{n}\lambda,$$

where n is the total number of the microphones in the microphone array and λ is a wavelength derived by a preset center frequency. The λ is defined by:

$$\lambda = \frac{C_0}{f}.$$

In the above, λ represents the wavelength, $C_0$ represents the speed of the acoustic wave in the air, and f represents the center frequency. The center frequency of basic array device may be set arbitrarily in accordance with the actual conditions. The band-pass filter has a center frequency corresponding to the basic array device, and has an operating frequency bandwidth that meet the directivity requirement set by the sound receiving system, that is, the bandwidth of each of the band-pass filters is set according to the center frequency, operating frequency range, directional characteristic and given directivity requirement of its corresponding basic array device.

For example, when the center frequency set in the basic array device is 400 Hz, the center frequency of the band-pass filter connected with the output terminal of the basic array device is also 400 Hz. When the operation bandwidth that meets the directivity requirement set in the basic array device is within a frequency range of (−⅓)~(+⅓) octave, the operation bandwidth of the band-pass filter is also within a frequency range of (−⅓)~(+⅓) octave that (315 Hz~500 Hz). The formula for calculating the octave width is N=log 2 (f2/f1).

In the basic array device, each microphone has an output terminal connected with one of the time delay circuits, each time delay circuit has an output terminal connected with an input terminal of the first sound-mixing output device, and the first sound-mixing output device has an output terminal connected with an input terminal of the filter.

In the basic array device, the i-th time delay circuit has a delay time defined by adding (n-i) times of unit time to a delay time of the last time delay circuit, where said unit time is a time for an acoustic signal with a frequency f at a center frequency given by the basic array device to travel between two adjacent microphones after the acoustic signal axially travelling into the microphone array, n is the total number of the microphones in the microphone array, and i has a value of 1, 2, 3, . . . , or n. The acoustic signal axially transmitting into the microphone array means that the acoustic signal transmits into the microphone array at an incidence angle of 0° or 180°. In addition, because the acoustic signal transmits into the microphone array axially, it can be known from the above that the distance between the two adjacent microphones that the acoustic signal travels is a straight-line distance between the two adjacent microphones, in this case, $$\frac{1}{n}\lambda,$$

thereby the time for the acoustic signal to travel between the two adjacent microphones is defined by:

$$t = \frac{1}{n}\lambda / C_0.$$

Ti is defined as the delay time of the i-th time delay circuit, and is such that $$T_i = \frac{(n-i)\cdot\lambda}{n\cdot C_0} + A,$$

where n is the total number of the microphones in the microphone array, i has a value of 1, 2, 3, . . . , or n, $C_0$ represents the speed of the acoustic wave in the air, and A represents the delay time of the last time delay circuit, that is A represents the delay time of the n-th time delay circuit and A can be set as any time depend on actual requirements. When i is 1, $T_1$ represents the delay time of the 1st time delay circuit, and the 1st time delay circuit is the time delay circuit connected with the 1st microphone $M_1$. When i is 2, 3, 4, . . . , n, the situation is similar to the above. For the n-th microphone $M_n$, if the delay time of the n-th time delay circuit which is connected to the n-th microphone $M_n$ is 0, the output terminal of the n-th microphone $M_n$ may be connected to the input terminal of the first mixing output unit directly, i.e., the output terminal of the n-th microphone $M_n$ can be not connected with a time delay circuit.

The center frequency of each of the basic array devices is set primarily based on users' actual demands in advance, and the center frequencies $f_k$ of the plurality of the basic array devices $H_1$, $H_1$, $H_3$ . . . $H_m$ in may be alike, or they may be different, where k takes on the values 1, 2, 3, . . . , m. The spacing distance between the two adjacent microphones in the basic array device and the delay time of each of the time delay circuits can be calculated respectively, after each of the basic array device is set with a corresponding center frequency based on users' demands and the total number of the microphones in each of the basic array devices is determined. In addition, when setting up the band-pass filter, the center frequency of the band-pass filter is set as the same as that of the basic array device. For example, the center frequency of the 1st basic array device may be set as 60 Hz, and in the process of fabricating a basic array device, the spacing distance between the two adjacent microphones in the 1st basic array device, the delay time of each of the time delay circuits and the center frequency of the 1st band-pass filter can be determined after the total number of the microphones in the 1st basic array device is determined based on actual requirements. The other basic array devices are similar to the above. This will result in a sound receiving system which can achieve maximum gain output for forward acoustic signals with different frequencies (frequency band) and maximum inhibition for backward acoustic signals with different frequencies (frequency band), with a certain directional characteristic.

In one embodiment, the sound receiving system includes five basic array devices, where the center frequencies of the 1st basic array device to the 5th basic array device are 40 Hz, 50 Hz, 63 Hz, 80 Hz and 100 Hz respectively, and the numbers of the microphones in the 1st basic array device to the 5th basic array device are 4, 5, 6, 7 and 8 respectively. The center frequencies of the 1st band-pass filter to the 5th band-pass filter are respectively 40 Hz, 50 Hz, 63 Hz, 80 Hz and 100 Hz accordingly. The spacing distance between two adjacent microphones in the 1st basic array device is $$\frac{1}{4}\cdot\frac{C_0}{40}.$$

If the delay time of the 4th time delay circuit is 0, the delay times of the 1st time delay circuit to the 3rd time delay circuit in the 1st basic array device are 18.75 ms, 12.5 ms and 6.25 ms respectively. The spacing distance between two adjacent microphones in the 2nd basic array device is $$\frac{1}{5}\cdot\frac{C_0}{50}.$$

If the delay time of the 5th time delay circuit is 0, the delay times of the 1st time delay circuit to the 4th time delay circuit in the 2nd basic array device are $$\frac{4}{250}s,\ \frac{3}{250}s,\ \frac{2}{250}s \text{ and } \frac{1}{250}s$$

respectively. The 3rd basic array device, the 4th basic array device and the 5th basic array device are similar to the above.

Then a formula for calculating the spacing distance dk between two adjacent microphones in the k-th basic array device can be expressed as $$d_k = \frac{1}{n_k} \cdot \frac{C_0}{f_k} = \frac{1}{n_k} \cdot \lambda_k,$$

where k takes on the values 1, 2, 3, . . . , m, m is the total number of the basic array devices in the sound receiving system, nk represents the total number of the microphones in the k-th basic array device and $f_k$ represents the center frequency of the k-th basic array device. When k is 1, $f_1$ represents the center frequency of the 1st basic array device, and the spacing distance d1 between two adjacent microphones in the 1st basic array device can be calculated and is $$\frac{1}{n_1}\lambda_1.$$

The time delay circuit ik in the k-th basic array device takes on the values 1k, 2k, 3k, . . . , nk that ik represents the i-th time delay circuit in the k-th basic array device, and the delay time Tki of the time delay circuit ik in the k-th basic array device is defined as $$T_{ki} = \frac{(n_k - i_k) \cdot \lambda_k}{n_k \cdot C_0} + A_k = \frac{n_k - i_k}{n_k \cdot f_k} + A_k,$$

where nk represents the total number of the microphones in the k-th basic array device, $f_k$ represents the center frequency of the k-th basic array device, k takes on the values 1, 2, 3, . . . , m, m is the total number of the basic array devices in the sound receiving system, ik takes on the values 1k, 2k, 3k, . . . , nk, and Ak represents the delay time of the last time delay circuit in the k-th basic array device.

As a preferred embodiment, the number of microphones in the microphone array of each of the basic array devices is the same.

However, when the number of microphones in the microphone array of each of the basic array devices is different, the frequency response, directional characteristic and others are different within the operating frequency range of the sound receiving system.

The instructions for the process of the present invention are basic and detailed below.

According to general knowledge in the art, an acoustic wave may be expressed as a mathematical expression as follows:

$$P=Pa\cos(\omega t-\phi).$$

When two acoustic waves with the same frequency are superposed together, there is $$Pa2=P1a2+P2a2+2P1aP2a\cos(\phi2-\phi1).$$

Then the superposition of two acoustic waves with the same amplitude (P1a=P2a) is as follows.

When the phase difference between the two acoustic waves is 0°, i.e., when $\phi2-\phi1=0$, the superposition of the two acoustic waves can be expressed as $$Pa2=P1a2+P2a2+2P1aP2a=(P1a+P2a)2=(2P1a)2$$

and $$LPa=101g(Pa/P0)2=101g(2P1a/P0)2=101g(P1a/P0)2+101g4=LP1a+6\text{ dB}.$$

From here we see that when two acoustic waves with the same frequency, phase and amplitude, are superposed together, the amplitude of the superposed acoustic wave is twice as that of each of the acoustic waves to be superposed, increasing about 6 dB.

When the phase difference between the two acoustic waves is 60°, i.e., when $$\varphi2-\varphi1=\frac{1}{3}\pi,$$

the superposition of the two acoustic waves can be expressed as $$Pa2=P1a2+P2a2+2P1aP2a\times½=3P1a2\text{ and}$$

$$LPa=101g(Pa/P0)2=101g(3P1a/P0)2=101g(P1a/P0)2+101g3=LP1a+4.8\text{ dB}.$$

From here we see that when two acoustic waves with the same frequency and amplitude and with a phase difference of $$\frac{1}{3}\pi,$$

are superposed together, the amplitude of the superposed acoustic wave is $\sqrt{3}$ times as that of each of the acoustic waves to be superposed, increasing about 4.8 dB.

When the phase difference between the two acoustic waves is 90°, i.e., when $$\varphi2-\varphi1=\frac{\pi}{2},$$

the superposition of the two acoustic waves can be expressed as $$Pa2=P1a2+P2a2+2P1aP2a\times0=2P1a2\text{ and}$$

$$LPa=101g(Pa/P0)2=101g2P1a2/P02=101g(P1a/P0)2+101g2=LP1a+3\text{ dB}.$$

From here we see that when two acoustic waves with the same frequency and amplitude and with a phase difference of $$\frac{\pi}{2},$$

are superposed together, the amplitude of the superposed acoustic wave is $\sqrt{2}$ times as that of each of the acoustic waves to be superposed, increasing about 3 dB.

When the phase difference between the two acoustic waves is 120°, i.e., when $$\varphi2-\varphi1=\frac{2}{3}\pi,$$

the superposition of the two acoustic waves can be expressed as $$Pa2=P1a2+P2a2+2P1aP2a\times(-½)=2P1a2-P1a2=P1a2.$$

From here we see that when two acoustic waves with the same frequency and amplitude and with a phase difference of $$\frac{2}{3}\pi,$$

are superposed together, the amplitude of the superposed acoustic wave is the same as that of the acoustic wave to be superposed, i.e., the superposed acoustic wave has the same acoustic pressure level as the acoustic waves to be superposed.

When the phase difference between the two acoustic waves is 180°, i.e., when $\phi 2-\phi 1=\pi$, the superposition of the two acoustic waves can be expressed as $$Pa2=P1a2+P2a2+2P1aP2a\times(-1)=(P1a-P2a)2=0.$$

From here we see that when two acoustic waves with the same frequency and amplitude and with a phase difference of $\pi$, are superposed together, the amplitude of the superposed acoustic wave is zero, i.e., the acoustic waves superposed cancel each other.

Based on the above, the result of superposition of two acoustic waves with the same frequency and amplitude mainly depends on the phase difference between the two acoustic waves, and according to different phase differences between the two acoustic waves, the amplitude of the superposed acoustic wave is different, ranged from zero to as twice as the amplitude of each of the acoustic waves to be superposed.

Similarly, the result of superposition of multiple acoustic waves with the same frequency and amplitude also depends on the phase difference between the multiple acoustic waves, and according to different phase differences between the multiple acoustic waves, the amplitude of the superposed acoustic wave is different, ranged from zero to as twice as the amplitude of each of the acoustic waves to be superposed. For example, when six acoustic waves with the same frequency and amplitude are superposed together, the amplitude of the superposed wave is ranged from 0 to 6PA, where PA is the amplitude of one acoustic wave.

Let the angle between the axial direction of the microphone array in the basic array device and the incident direction of the acoustic signal be $\phi$, i.e., the acoustic signal is incident on the microphone array at the angle of $\phi$. The acoustic signal may be a plane wave or an approximate plane wave (far field acoustic signal or approximate far field acoustic signal), and the difference in amplitudes of the acoustic signals received by the microphones due to different transmitting distances may be ignored;

the phase angles of the acoustic signals received by the microphones are $\Phi_i'$ respectively;

the times that the microphones actually receive the acoustic signals are $t_i$ respectively;

the phase angles of the acoustic signals respectively corresponding to the delay times of the time delay circuits are $\Phi_i^*$;

the center frequency of the basic array device is $f_0$, that is, the center frequency of the microphone array in the basic array device is $f_0$; and the straight-line distance between the 1st microphone and the n-th microphone is $L_{1-n}$.

When an acoustic signal with a phase angle of $\alpha$ and a frequency of the center frequency $f_0$ is incident on the 1st microphone M1 at a angle of $\phi$ at time t1=0, i.e., the 1st microphone M1 receives an acoustic signal with a phase angle of $\alpha$ and a frequency of the center frequency $f_0$ at time t1=0. The acoustic signal will continue to travel to the i-th microphone Mi after it reaches the 1st microphone M1, the distance it travels from the 1st microphone M1 to the i-th microphone Mi is $$\frac{i-1}{n}\lambda_0\cos\varphi,$$

and the distance between the phase angle of the acoustic signal received by the i-th microphone Mi at $t_i$ and the phase angle of the acoustic signal received by the 1st microphone M1 is $$\Phi_i' = \frac{((i-1)/n)\lambda_0\cos\varphi}{C_0/f_0}\times 360^\circ + \alpha,$$

where $\alpha$ can be omitted, because $\alpha$ is a constant in the above expression when the phase angle of the incident acoustic signal is $\alpha$. In addition, i has a value of 1, 2, 3, . . . , or n, and n is the total number of the microphones.

When an acoustic signal with a phase angle of 0° and a frequency of the center frequency $f_0$ is incident on the 1st microphone M1 at a angle of $\phi$ at time t1=0, i.e., the 1st microphone M1 receives an acoustic signal with a phase angle of 0° and a frequency of the center frequency $f_0$ at time t1=0. The acoustic signal will continue to travel to the i-th microphone Mi after it reaches the 1st microphone M1, the distance it travels from the 1st microphone M1 to the i-th microphone Mi is $$\frac{i-1}{n}\lambda_0\cos\varphi,$$

and the distance between the phase angle of the acoustic signal received by the i-th microphone Mi at $t_i$ and the phase angle of the acoustic signal received by the 1st microphone M1 is $$\Phi_i' = \frac{((i-1)/n)\lambda_0\cos\varphi}{C_0/f_0}\times 360^\circ,$$

where i has a value of 1, 2, 3, . . . , or n. Thus the phase angle $\Phi_i'$ of the acoustic signals received by the 2nd microphone, the 3rd microphone, . . . , n-th microphone respectively can be calculated from the above expression.

The phase angles of the acoustic signals respectively corresponding to the delay times of the time delay circuits are $$\Phi_i'' = \frac{T_i}{1/f_0}\times 360^\circ,$$

where i has a value of 1, 2, 3, . . . , or n.

The phase angle $\Phi_i$ of the acoustic signal output by each time delay circuit is $$\Phi_i=\Phi_i'+\Phi_i''.$$

From here we see that the basic array device is designed with the idea to ensure that the delay time of the i-th delay circuit is consistent with the time an acoustic signal with a frequency of the center frequency $f_0$ travels to the last microphone after the acoustic signal is forward and axially incident on the i-th microphone.

Suppose the number of microphones in the microphone array is less than 3. For example, the number of microphones in the microphone array is 2.

In this case, an acoustic signal with a frequency of the center frequency $f_0$ and a phase angle of $\alpha$ is forward and axially incident on the microphone array at a angle of $\phi$, where $\phi=0°$. The acoustic signal travels through the 1st microphone and the 1st time delay circuit in sequence, and the output electrical signal has a phase angle of $\alpha+180°$, where the increased angle of 180° is caused by the time delay circuit. The acoustic signal then travels from the 1st microphone to the 2nd microphone and travels through the 2nd time delay circuit, where the delay time of the 2nd time delay circuit is 0 that the output electrical signal still has a phase angle of $\alpha+180°$. It follows that the phase angle of the electrical signal output from the 1st time delay circuit is consistent with that of the electrical signal output from the 2nd time delay circuit, that is the phase difference between the both electrical signals is 0, such that the electrical signal output has a maximum gain.

In another case, an acoustic signal with a frequency of the center frequency $f_0$ and a phase angle of $\alpha$ is backward and axially incident on the microphone array at a angle of $\phi$, where $\phi=180°$. The acoustic signal firstly reaches the 2nd microphone, and travels through the 2nd microphone and the 2nd time delay, where the delay time of the 2nd time delay circuit is 0 that the output electrical signal still has a phase angle of $\alpha$. The acoustic signal travels from the 2nd microphone to the 1st microphone and travels through the 1st time delay circuit, and the phase angle of the output electrical signal is a combination of $\alpha$, 180° caused by the delay time of the time delay circuit and 180° caused by the transmission distance, i.e., $\alpha+360°$. It follows that the phase angle of the electrical signal output from the 2nd time delay circuit lags behind that of the electrical signal output from the 1st time delay circuit by 360°, that is the phase difference between the both electrical signals is 0, such that the amplitude of the electrical signal output is also doubled.

That is, for a backward incoming acoustic signal with a frequency of the center frequency $f_0$, the basic array device also plays a role in double in the amplitude of the acoustic signal.

In other words, a basic array device including a microphone array only composed of two microphones cannot plays an inhibition role in a backward axially incoming acoustic signal.

Suppose the number of microphones in the microphone array is 3, when an acoustic signal with a frequency as the center frequency $f_0$ and a phase angle of $\alpha$ is forward and axially incident on the microphone array, the acoustic signal travels through the 1st microphone and the 1st time delay circuit in sequence, and the output electrical signal has a phase angle of $\alpha+240°$, where the increased angle of 240° is caused by the time delay circuit. The acoustic signal travels from the 1st microphone to the 2nd microphone and travels through the 2nd microphone and the 2nd time delay circuit in sequence, and the output electrical signal has a phase angle as a combination of $\alpha$, 120° caused by the delay time of the time delay circuit and 120° caused by the transmission distance, i.e., $\alpha+240°$. The acoustic signal travels from the 2nd microphone to the 3rd microphone and travels through the 3rd microphone and the 3rd time delay circuit in sequence, where the delay time of the 2nd time delay circuit is 0 that the output electrical signal has a phase angle as a combination of $\alpha$, and 240° caused by the transmission distance, i.e., $\alpha+240°$. It follows that the phase angle of the electrical signal output from the 1st time delay circuit, the phase angle of the electrical signal output from the 2nd time delay circuit and the phase angle of the electrical signal output from the 3rd time delay circuit are consistent, that is the phase difference between the three electrical signals is 0, such that the electrical signal output has a maximum gain.

When the attenuation of the acoustic wave caused by transmission in the air is ignored, the basic array device can output an electrical signal of which the amplitude is nearly three times as that of an electrical signal output from a single microphone, that is, the gain of the basic array device can be up to or close to 4.77 dB.

When an acoustic signal with a frequency of the center frequency $f_0$ and a phase angle of $\alpha$ is backward and axially incident on the microphone array, the acoustic signal firstly reaches the 3rd microphone, and travels through the 2nd microphone and the 3rd time delay, where the delay time of the 3rd time delay circuit is 0 that the output electrical signal still has a phase angle of $\alpha$. The acoustic signal travels from the 3rd microphone to the 2nd microphone and travels through the 2nd time delay circuit, and the phase angle of the output electrical signal is a combination of $\alpha$, 120° caused by the delay time of the time delay circuit and 120° caused by the transmission distance, i.e., a+240°. The acoustic signal travels from the 2nd microphone to the 1st microphone and travels through the 1st time delay circuit, and the phase angle of the output electrical signal is a combination of $\alpha$, 240° caused by the delay time of the time delay circuit and 240° caused by the transmission distance, i.e., a+480°. It follows that when the attenuation of the acoustic wave caused by transmission in the air is ignored, the amplitude of the electrical signal corresponding to the acoustic signal finally output is 0 or close to 0.

That is, for a backward incoming acoustic signal with a frequency of the center frequency $f_0$, when the number of the microphones in the microphone array is 2, the basic array device can play an inhibition role in a backward axially incoming acoustic signal.

The total number n of the microphones in the microphone array is equal or greater than 3, i.e., the microphone array has at least 3 microphones. Once the microphone array has more microphones, the electrical signal corresponding to the forward acoustic signal, output from the microphone array and time delay circuits can has a greater gain within a center frequency bandwidth, the attenuation of the backward acoustic signal can be further enhanced, and the directional characteristic of the acoustic signal can be improved.

Figure 2:
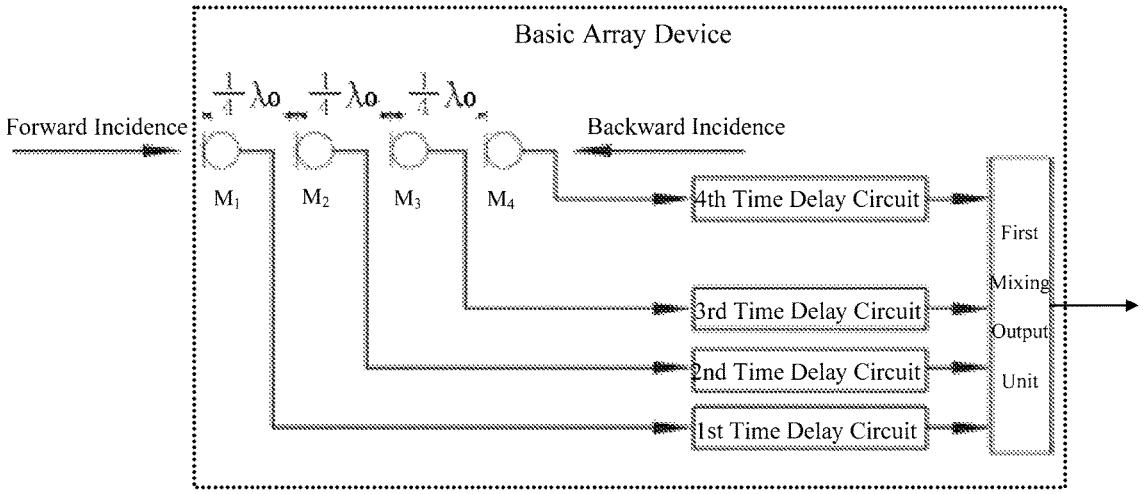
FIG. 2 is a structure diagram illustrating a basic array device in a sound receiving system according to one embodiment of the present invention.

As shown in FIG. 2, the microphone array in the basic array device includes four microphones which are M1, M2, M3 and M4. The four microphones are longitudinally arranged along a straight line in order, with a center frequency of $f_0$, such that the spacing distance between two adjacent microphones is $$\frac{1}{4}\lambda_0.$$

In a case, an acoustic signal with a frequency of the center frequency $f_0$ and a phase angle of 0° is incident on the microphone array at a angle of $\phi=0°$.

(1) At t1=0, the acoustic signal reaches the 1st microphone M1, and the acoustic signal received by the 1st microphone M1 has a phase angle that Φ1'=0°;

$$t2 = \frac{1}{4}\lambda_0 / C_0,$$

the acoustic signal reaches the 2nd microphone M2, and the acoustic signal received by the 2nd microphone M2 has a phase angle that Φ2'=90°;

$$t3 = \frac{1}{2}\lambda_0 / C_0,$$

the acoustic signal reaches the 3rd microphone M3, and the acoustic signal received by the 3rd microphone M3 has a phase angle that Φ3'=180°; and $$t4 = \frac{3}{4}\lambda_0 / C_0,$$

the acoustic signal reaches the 4th microphone M4, and the acoustic signal received by the 4th microphone M4 has a phase angle that Φ4'=270°.

Because the delay time of the 4th time delay circuit is 0, the delay time Ti of the i-th time delay circuit is $$T_i = \frac{(n-i)\cdot\lambda_0}{n\cdot C_0}.$$

In this case, n is 4, and i is 1, 2 or 3.

Based on the above expression, the delay times of the 1st time delay circuit, 2nd time delay circuit and 3rd time delay circuit can be calculated respectively, and the phase angles of the acoustic signals corresponding to the delay times of the 1st to 4th time delay circuits respectively can also be calculated, as follows.

(1) The delay time of the 1st time delay circuit is $$T_1 = \frac{3}{4}\lambda_0 / C_0.$$

And the phase angle of the acoustic signal corresponding to the delay time is $\Phi_1''=270°$.

(2) The delay time of the 2nd time delay circuit is $$T_2 = \frac{1}{2}\lambda_0 / C_0.$$

And the phase angle of the acoustic signal corresponding to the delay time is $\Phi_2''=180°$.

(3) The delay time of the 3rd time delay circuit is $$T_3 = \frac{1}{4}\lambda_0 / C_0.$$

And the phase angle of the acoustic signal corresponding to the delay time is $\Phi_3''=90°$.

(4) The delay time of the 4th time delay circuit is 0.

And the phase angle of the acoustic signal corresponding to the delay time is $\Phi_4''=0°$.

The phase angles of the electrical signals output from the time delay circuits can be further calculated, as follows.

The acoustic signal travels through the 1st microphone and the 1st time delay circuit in sequence, and the output electrical signal has a phase angle that $\Phi_1=\Phi_1'+\Phi_1''=270°$.

The acoustic signal travels through the 2nd microphone and the 2nd time delay circuit in sequence, and the output electrical signal has a phase angle that $\Phi_2=\Phi_2'+\Phi_2''=270°$.

The acoustic signal travels through the 3rd microphone and the 3rd time delay circuit in sequence, and the output electrical signal has a phase angle that $\Phi_3=\Phi_3'+\Phi_3''=270°$.

(4) The acoustic signal travels through the 4th microphone and the 4th time delay circuit in sequence, and the output electrical signal has a phase angle that $\Phi_4=\Phi_4'+\Phi_4''=270°$.

Based on the above, the electrical signals from the four microphone are delayed by respective time delay circuits, and the phase angles of the output electrical signals are 270°. Thus the electrical signal output from the basic array device has a maximum gain.

In another case, an acoustic signal with a frequency of the center frequency $f_0$ and a phase angle of 0° is incident on the microphone array at a angle of ϕ=180°.

(1) At t5=0, the acoustic signal reaches the 4th microphone M4, and the acoustic signal received by the 4th microphone M4 has a phase angle that Φ4'=0°;

$$t6 = \frac{1}{4}\lambda_0 / C_0,$$

the acoustic signal reaches the 3rd microphone M3, and the acoustic signal received by the 3rd microphone M3 has a phase angle that Φ3'=90°;

$$t7 = \frac{1}{2}\lambda_0 / C_0,$$

the acoustic signal reaches the 2nd microphone M2, and the acoustic signal received by the 2nd microphone M2 has a phase angle that Φ2'=180°; and $$t8 = \frac{3}{4}\lambda_0 / C_0,$$

the acoustic signal reaches the 1st microphone M1, and the acoustic signal received by the 4th microphone M1 has a phase angle that Φ1'=270°.

Because the delay times of the time delay circuits corresponding to the microphones are the same as the above case, the phase angles are still the same that Φ1"=270°, ψ2"=180°, Φ3"=90° and Φ4"=0°.

The phase angles of the electrical signals output from the time delay circuits can be further calculated, as follows.

The acoustic signal travels through the 1st microphone and the 1st time delay circuit in sequence, and the output electrical signal has a phase angle that $$\psi 1=\Phi 1'+\Phi 1''=270°+270°=540°.$$

The acoustic signal travels through the 2nd microphone and the 2nd time delay circuit in sequence, and the output electrical signal has a phase angle that $$\Phi 2=\Phi 2'+\Phi 2''=180°+180°=360°.$$

The acoustic signal travels through the 3rd microphone and the 3rd time delay circuit in sequence, and the output electrical signal has a phase angle that $$\Phi 3=\Phi 3'+\Phi 3''=90°+90°=180°.$$

The acoustic signal travels through the 4th microphone and the 4th time delay circuit in sequence, and the output electrical signal has a phase angle that $$\Phi 4=\Phi 4'+\Phi 4''=0°+0°=0°.$$

Based on the above, Φ1 and Φ2 have opposite phases, and Φ3 and Φ4 have opposite phases. When the attenuation of the acoustic wave caused by transmission in the air is ignored, the amplitude of the electrical signal finally output from the basic array device is 0, with a minimum gain.

Further, when the spacing distance between any two adjacent microphones is $$\frac{1}{n}\lambda_0,$$

and the number of microphones is an even number greater than or equal to 4, the attenuation of the output acoustic signal can maintain at a minimum within a center frequency bandwidth.

As a preferred embodiment, the total number n of the microphones in the microphone array is an even number greater than or equal to 4. When the incidence angle $\phi$ is 180° and the attenuation of the acoustic wave caused by transmission in the air is ignored, the electrical signals output from the microphones in the microphone array cancel each other to get the maximum attenuation.

Because the acoustic signal may be incident on the microphone array of the basic array device at different angles, when the incidence angle $\phi$ of the acoustic signal being incident on the microphone array is neither 0° nor 180°, the distance $$\frac{i-1}{n}\lambda_0\cos\varphi$$

that the acoustic signal travels to each microphone is varied in direction with the incidence angle $\phi$. The directivity of the basic array device is sharper than that of a single microphone due to $\cos\phi\leq 1$. When the directional characteristic of the single microphone is not omni-directional, the directional characteristic of the basic array device is sharper. As the number of the microphones increases, the gain of the output signal of the basic array device will continue to increase when the incidence angle $\phi$ of the acoustic signal is 0°, and the gain of the output signal of the basic array device will maintain at a minimum when the incidence angle $\phi$ of the acoustic signal is 180°, i.e., with the increase in the number of the microphones, the directivity of the basic array device will become sharper.

In addition, when the frequency f of the acoustic signal being incident on the basic array device is different with the center frequency $f_0$, i.e., $f\neq f_0$. The ratio of f to $f_0$ will affect the gain and directional characteristic of the basic array device.

Figure 3:
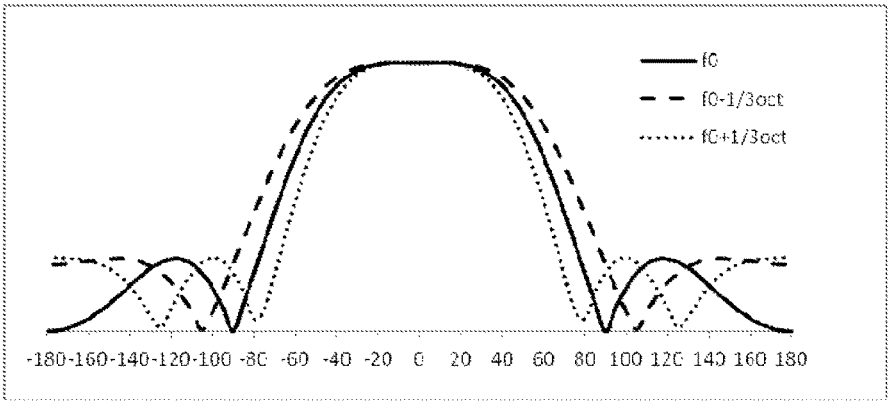
FIG. 3 is a schematic diagram showing a relationship between frequencies and directional responses of output of a basic array device including a microphone array including four microphones.

As shown in FIG. 3, showing a relationship between frequencies and directional responses of output of a basic array device including a microphone array including four microphones, when the ratio of f to $f_0$ is close to 1, the basic array device can only work in a narrow frequency range. Within a frequency range of (−⅓)~(+⅓) octave, the basic array device can obtain approximately identical gain and directional characteristic in the frequency range. Know then, the directional characteristic of the basic array device is related to the ratio of the frequency f of the acoustic signal being incident on the microphone array of the basic array device to the center frequency $f_0$ and is unrelated to the specific value of the center frequency $f_0$.

Therefore, according to the present invention, various basic array devices with different center frequencies $f_0$ can get obtain an identical directional characteristic.

Figure 4:
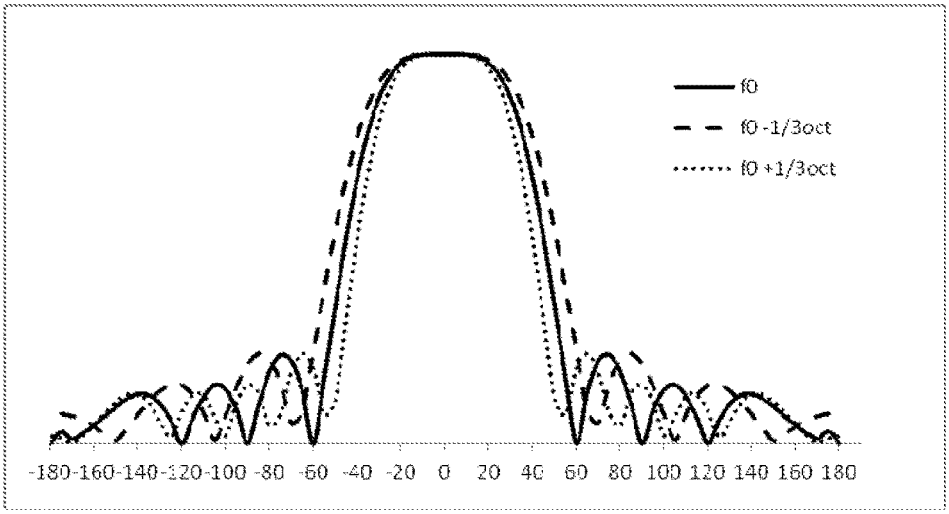
FIG. 4 is a schematic diagram showing a relationship between frequencies and directional responses of output of a basic array device including a microphone array including eight microphones.

As shown in FIG. 4, showing a relationship between frequencies and directional responses of output of a basic array device including a microphone array including eight microphones, when the ratio of f to $f_0$ is close to 1, the basic array device can only work in a narrow frequency range. Within a frequency range of (−⅓)~(+⅓) octave, the basic array device can obtain approximately identical gain and directional characteristic in the frequency range. Compared FIG. 3 with FIG. 4, we can see that the basic array device including a microphone array including eight microphones has a greater gain for forward acoustic wave, more attenuation for the backward acoustic wave, and better directional characteristic.

Therefore, the total number n of the microphones in the microphone array should be an even number greater than or equal to 4, and the greater the number of microphones, the better the directional characteristic of receiving the acoustic wave is.

Based on the characteristics of a single basic array device, if a plurality of basic array devices with different center frequencies $f_0$ make up a system, the system will has the similar gain and directional characteristic within a given pass-band range. The system of the present invention can receive various acoustic signals with different frequencies in the pass-band range, improve the output of the forward acoustic wave actuation in these frequencies and decrease the output of the oblique acoustic wave in these frequencies.

Figure 5:
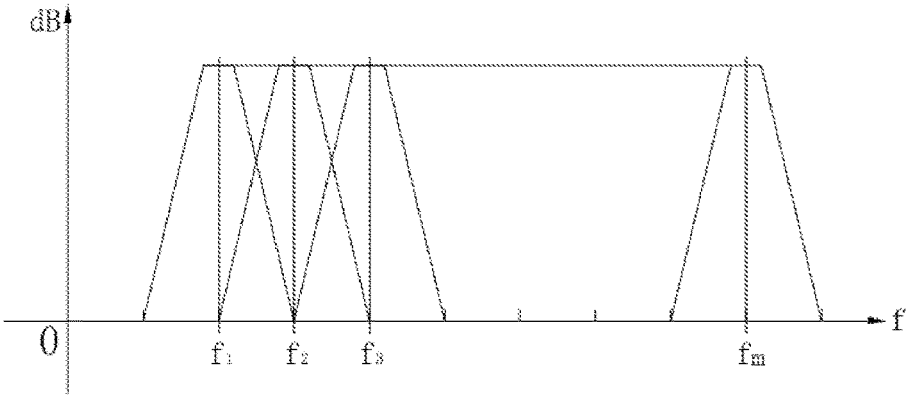
FIG. 5 is a schematic diagram showing an output frequency response of a plurality of band-pass filters according to one embodiment of the present invention.

In addition, in order to ensure that the output acoustic signal can achieve the maximum gain and the outputs of the basic array devices won't interfere with each other, the sound receiving system is provided with band-pass filters corresponding to the center frequencies of the basic array devices respectively, such that the present invention can achieve the purpose of the best anti-interference. For the plurality of the band-pass filters, because their center frequencies are f1, f2, f3, . . . , fm respectively, which correspond to the center frequencies of the basic array devices respectively, the output frequency responses of the plurality of the band-pass filters are as shown in FIG. 5. The pass bands of the band-pass filters are adjoined to one another to form a complete channel that meets with the given operating frequency range.

In order to achieve a better sound receiving effect and have an approximately identical directional characteristic within a given operating frequency range, the center frequencies f1, f2, f3, . . . , fm of the plurality of the basic array devices are continuously and evenly arranged with an interval of x/m octaves, where m is the total number of the basic array devices, and x octaves is a total frequency range given in the sound receiving system. The total number m of the basic array devices can be determined by a controlled directional total frequency bandwidth given in the sound receiving system, a controlled directional characteristic given in the sound receiving system, controlled directional frequency bandwidths of the basic array devices and the controlled directional characteristic of the basic array devices.

In addition, the total number m of the basic array devices in the sound receiving system also can be determined (increased or decreased) by the frequency response and special directional requirement of a special frequency band of the whole frequency band given in the sound receiving system. In this case, frequency response, directional characteristic and others may be different within the operating frequency range of the sound receiving system.

Moreover, the center frequencies of the plurality of the basic array devices in the sound receiving system also can be arranged with an uneven interval. But in this case, frequency response, directional characteristic and others may be different within the operating frequency range of the sound receiving system.

Because the center frequencies f1, f2, f3, . . . , fm of the plurality of basic array devices are continuously and evenly arranged with an interval of x/m octaves, the frequency responses of the basic array device may be narrowed by increasing the number of the basic array devices within the given operating frequency range. In this case, the combination of a plurality of the basic array devices has characteristic variations as follows: the sensitivity of receiving the forward acoustic signal within the given operating frequency range will be improved, the attenuations of backward acoustic waves tend to be consistent and tend to be zero, and the directional characteristics of different frequencies will also be consistent; otherwise, if the number of the basic array devices is deceased, the sensitivity within the whole given frequency range will be reduced, and the attenuations of acoustic waves with different frequencies from other directions except forward tend to be inconsistent, that is, the dispersion will be increased and the directional characteristic will became worse.

In addition, when the center frequencies of the plurality of basic array devices are arranged with an interval of x/m octaves (m is the total number of the basic array devices, and x octaves is a total frequency range given in the sound receiving system), if the number of microphones in one or a few basic array devices are increased or decreased, the basic array device with increased microphones will have a greater sensitivity in its operating frequency and a sharper directional characteristic, while the basic array device with decreased microphones will have a lower sensitivity in its operating frequency and a slower directional characteristic. Thus, the number of the basic array devices and the number of microphones in the basic array device should be determined in accordance with the actual conditions, to meet the special requirements that a special sound receiving system has different responses to individual frequency ranges.

Furthermore, when the center frequencies of the plurality of basic array devices are not arranged with an interval of x/m octaves, the interval of center frequencies of the basic array devices in one frequency range or some frequency ranges may become larger or smaller. In the operating frequency with a smaller arrangement interval of the center frequency, the sensitivity will be improved, and the directional characteristic will be sharper, while in the operating frequency with a larger arrangement interval of the center frequency, the sensitivity will be reduced, and the directional characteristic will be slower. Thus the arrangement of the center frequencies of the basic array devices should be determined in accordance with the actual conditions, to meet the special requirements that a special sound receiving system has special responses to special frequency ranges.

Preferred embodiments are described as follows.

1. The number of the microphones in the microphone array of each of the basic array devices of the sound receiving system is an even number greater than or equal to 4, and each of the basic array devices has the same number of the microphones. In this way, the whole sound receiving system will have a coincident gain within the given frequency bandwidth.

2. The last microphone in the microphone array of each of the basic array devices of the sound receiving system is placed together in a same physical location and close to one another. In this way, the delay time of the time delay circuit connected with the last microphone can be set as zero, that is, a time delay circuit can be omitted.

3. The microphone array of each of the basic array devices of the sound receiving system has the same number of the microphones, and when the center frequencies of the plurality of basic array devices are continuously and evenly arranged with an interval of x/m octaves, bandwidths of the plurality of band-pass filters have a same octave, and the bandwidths of the plurality of band-pass filters cover a given total frequency bandwidth. That is, the bandwidths the band-pass filters connected with the output terminals of the basic array devices can be set yo have a same octave. In this way, the sound receiving system will have a coincident gain within the frequency bandwidth given in the sound receiving system.

4. The microphone array of each of the basic array devices of the sound receiving system has the same number of the microphones, and when the center frequencies of the plurality of basic array devices are continuously and evenly arranged with an interval of x/m octaves, the band-pass filters, which are connected with the output terminals of the basic array devices in the sound receiving system and have center frequencies corresponding to the basic array devices, except the first filter at the low frequency end and the last filter at the high frequency, can be set to have bandwidths with the same octave. Meanwhile, the low-frequency cutoff of the first filter at the low frequency end is set as passband that the filter connected with the output terminal of the first basic array device is a low-pass filter, and the high frequency end of the low-pass filter is the same as that of other band-pass filters, then its frequency of high-frequency cutoff is set. While the high-frequency cutoff of the last filter at the high frequency end is set as passband that the filter connected with the output terminal of the last basic array device is a high-pass filter, and the low frequency end of the high-pass filter is the same as that of other band-pass filters, then its frequency of low-frequency cutoff is set. In this way, the sound receiving system can receive acoustic signals with frequencies beyond the frequency bandwidth given in the sound receiving system that the operating frequency bandwidth is expanded, but the directional characteristic of the acoustic signal with frequencies beyond the given frequency bandwidth can not be controlled.

Figure 6:
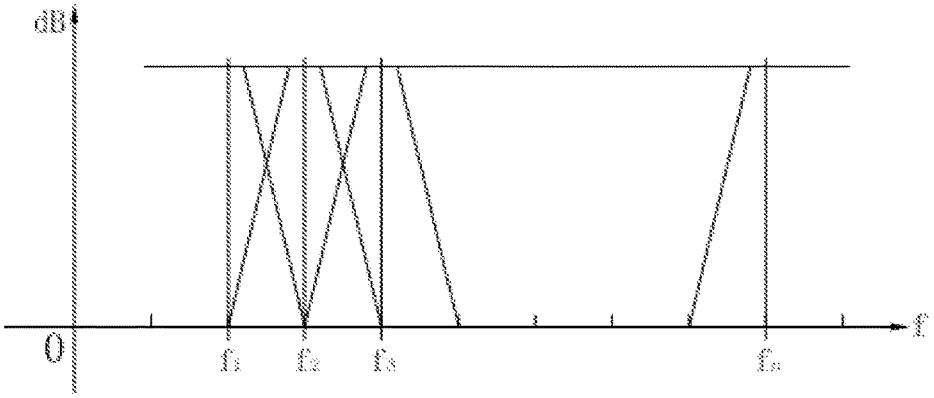
FIG. 6 is a schematic diagram showing an output frequency response of a low-pass filter, a plurality of band-pass filters and a high-pass filter according to one embodiment of the present invention.

It can be known from the above that in the sound receiving system, the first filter at the low frequency end in the plurality of filters is a low-pass filter, the last filter at the high frequency end in the plurality of filters is a high-pass filter, the rest plurality of filters are band-pass filters with a frequency corresponding to the center frequency of the basic array device, the bandwidths of the rest plurality of band-pass filters have a same octave. In this case, the output frequency responses of the low-pass filter, the plurality of band-pass filters and the high-pass filter in the sound receiving system are shown in FIG. 6.

Based on the above, the present invention can selectively receive various acoustic signals, improve the output of the forward acoustic wave actuation of these frequencies and decrease the output of the oblique acoustic wave, within a center frequency bandwidth. The present invention has wide applications. For example, it can be used for sound pickup (sound transmitting) in a conference. The sound receiving device of the present invention may be hung from the roof the center of the conference room, such that most spokesmen can be covered, and when sound pickup (sound transmitting), various acoustic wave feedbacks can be suppressed without complicated regulation, howling is not easy to be produced, and unwanted noise can be isolated; it can be used for long distance sound pickup (sound transmitting) in a theatre, which not only covers the entire stage to record the required sound, but also blocks out interference from the grandstand in the theatre; and it can also be used for ultra distance special sound pickup (sound transmitting).

The embodiments are chosen and described in order to explain the principles of the present invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A sound receiving system, comprising:

a plurality of basic array devices, a plurality of filters and a second sound-mixing output device, wherein each of the plurality of basic array devices has an output terminal connected with one filter, each of the plurality of filters has an output terminal connected with an input terminal of the second sound-mixing output device, and the second sound-mixing output device has an output terminal serving as an output terminal of the sound receiving system;

the basic array device comprises a microphone array, a plurality of time delay circuits and a first sound-mixing output device, wherein the microphone array includes a plurality of microphones longitudinally arranged along a straight line in order, each microphone in the microphone array is separated with a distance from an adjacent microphone of the microphone array of $$\frac{1}{n}\lambda$$

where n is the total number of the microphones in the microphone array and A, and λ is a wavelength defined by a speed of an acoustic wave in air divided by a center frequency of the basic array device;

in the microphone array, each microphone has an output terminal connected with one of the time delay circuits, each time delay circuit has an output terminal connected with an input terminal of the first sound-mixing output device, and the first sound-mixing output device has an output terminal connected with an input terminal of the filter;

the i-th time delay circuit in the basic array device has a delay time defined by adding (n−i) times of unit time to a delay time of the last time delay circuit, where said unit time is a time for an acoustic signal with a frequency at a center frequency given by the basic array device to travel between two adjacent microphones after the acoustic signal axially travelling into the microphone array, n is the total number of the microphones in the microphone array, and i has a value of 1, 2, 3, . . . , or n; and the total number n of the microphones in the microphone array is an integer greater than or equal to 3;

wherein the center frequencies of the plurality of basic array devices are continuously and evenly arranged with an interval of x/m octaves, where m is the total number of the basic array devices, and x octaves is a total frequency range given in the sound receiving system.

2. The sound receiving system of claim 1, wherein each of the plurality of filters is a band-pass filter and the band-pass filter has a center frequency corresponding to the basic array device.

3. The sound receiving system of claim 1, wherein the number of the microphones in the microphone array of each of the basic array devices is the same.

4. The sound receiving system of claim 2, wherein bandwidths of the plurality of band-pass filters have a same octave, and the bandwidths of the plurality of band-pass filters cover a given total frequency bandwidth.

5. The sound receiving system of claim 1, wherein the first filter at the low frequency end in the plurality of filters is a low-pass filter, the last filter at the high frequency end in the plurality of filters is a high-pass filter, the rest plurality of filters are band-pass filters with a frequency corresponding to the center frequency of the basic array device, the bandwidths of the rest plurality of band-pass filters have a same octave.

6. The sound receiving system of claim 1, wherein the total number n of the microphones in the microphone array is an even number greater than or equal to 4.

7. The sound receiving system of claim 1, wherein the last microphone in the microphone array of each of the basic array devices is placed together in a same physical location and close to one another.

8. The sound receiving system of claim 1, wherein the basic array device and the band-pass filter have operating frequency bandwidths that meet directivity requirements.

* * * * *